United States Patent [19]

Skogberg

[11] 4,423,986

[45] Jan. 3, 1984

[54] METHOD AND INSTALLATION APPARATUS FOR ROCK BOLTING

[75] Inventor: Bo T. Skogberg, Handen, Sweden

[73] Assignee: Atlas Copco Aktiebolag, Nacka, Sweden

[21] Appl. No.: 299,642

[22] Filed: Sep. 4, 1981

[30] Foreign Application Priority Data

Sep. 8, 1980 [SE] Sweden ..... 8006252

[51] Int. Cl.[3] ..... E21D 20/00

[52] U.S. Cl. ..... 405/259; 411/19

[58] Field of Search ..... 405/259, 260, 261, 288, 405/289, 303, 225; 29/421 R, 523; 285/96, 105, 107; 299/21; 411/19

[56] References Cited

U.S. PATENT DOCUMENTS

| | | | |
|---|---|---|---|
| 3,665,719 | 5/1972 | Whiting | 405/289 |
| 4,125,937 | 11/1978 | Brown et al. | 29/421 R X |
| 4,140,426 | 2/1979 | Knox | 405/227 X |
| 4,334,804 | 6/1982 | Lindeboom | 405/259 |

FOREIGN PATENT DOCUMENTS 2015057 9/1979 United Kingdom .

*Primary Examiner*—David H. Corbin

*Attorney, Agent, or Firm*—Frishauf, Holtz, Goodman and Woodward

[57] ABSTRACT

A rock bolt is manufactured from a steel tube which has been deformed to have a deep depression so that it assumes a substantially reduced diameter. A sleeve is pressed onto the outer end thereof which is sealed through welding. An installation chuck carried on an installation rod comprises a socket for receiving the outer sleeve and when the rock bolt has been manually inserted in a borehole, for example by means of the chuck, high pressure liquid is conveyed through passages in the chuck to a hole which leads through the sleeve to an interior chamber of the tube so that the tube expands through plastic deformation, thereby anchoring the rock bolt in the borehole. The chuck is then relieved of pressure and removed from the anchored rock bolt.

20 Claims, 10 Drawing Figures

METHOD AND INSTALLATION APPARATUS FOR ROCK BOLTING

CROSS REFERENCE TO RELATED APPLICATION

U.S. patent application Ser. No. 127,776, filed Mar. 6, 1980, the entire contents of which are incorporated herein by reference.

BACKGROUND OF THE INVENTION

This invention relates to a method of rock bolting using an expansible tube-formed rock bolt that is pressurized to expand in a borehole, and also to an installation device for installing an expansible rock bolt, wherein the rock bolt comprises a tube that has an axial depression and is closed at both of its ends.

It is an object of the invention to provide for simple and fast installation of rock bolts which have good rock stabilizing properties.

SUMMARY OF THE INVENTION

In accordance with the invention, a method of rock bolting by using a fluid expansible tube-formed rock bolt having an internal elongated pressure fluid receiving chamber that is closed at both of its ends but has a fluid inlet at one end thereof which is in fluid communication with said chamber, said chamber being pressurized to expand the tube formed rock bolt in a borehole, is characterized by the steps of: inserting said one end of said rock bolt in a bolt socket of a holder so that a fluid conduit of said holder is in fluid communication with said fluid inlet (18) of said rock bolt; moving said holder to insert said rock bolt into a borehole; supplying high pressure liquid through said fluid conduit of said holder and through said fluid inlet to said chamber of said rock bolt to plastically deform said rock bolt so as to be expanded and anchored in the borehole; relieving said conduit of fluid pressure and thereby relieving said chamber of said rock bolt of fluid pressure; and removing said holder from said rock bolt, said rock bolt remaining anchored in the borehole.

Alternatively, the rock bolt can be inserted in the borehole, the chuck thereafter being engaged with the bolt to pressurize same.

According to another aspect of the invention, a combination of an expansible rock bolt and an installation device for same wherein said rock bolt comprises an elongated tube that has an internal pressure fluid receiving chamber which is closed at both of its ends but has a fluid inlet, is characterized in that:

the rock bolt further comprises a sleeve on one end of the tube which is the outer end of said tube, said sleeve having a hole through said sleeve to said internal chamber of said tube said hole forming said fluid inlet; and said installation device comprises: a holder having a socket for receiving said sleeve; two axially spaced sealing means in said socket for sealing against said sleeve on opposite sides of said hole of said sleeve; and passage means ending axially of said holder between said two axially spaced sealing means; said hole in said sleeve being arranged to be located axially between said two axially spaced sealing means and in fluid communication with said passage means when said sleeve is home in said socket; and means for coupling said passage means to a source of pressure fluid for expanding the tube by being fed from said passage and through said hole in said sleeve and into said chamber of said tube.

DETAILED DESCRIPTION

Figure 1:
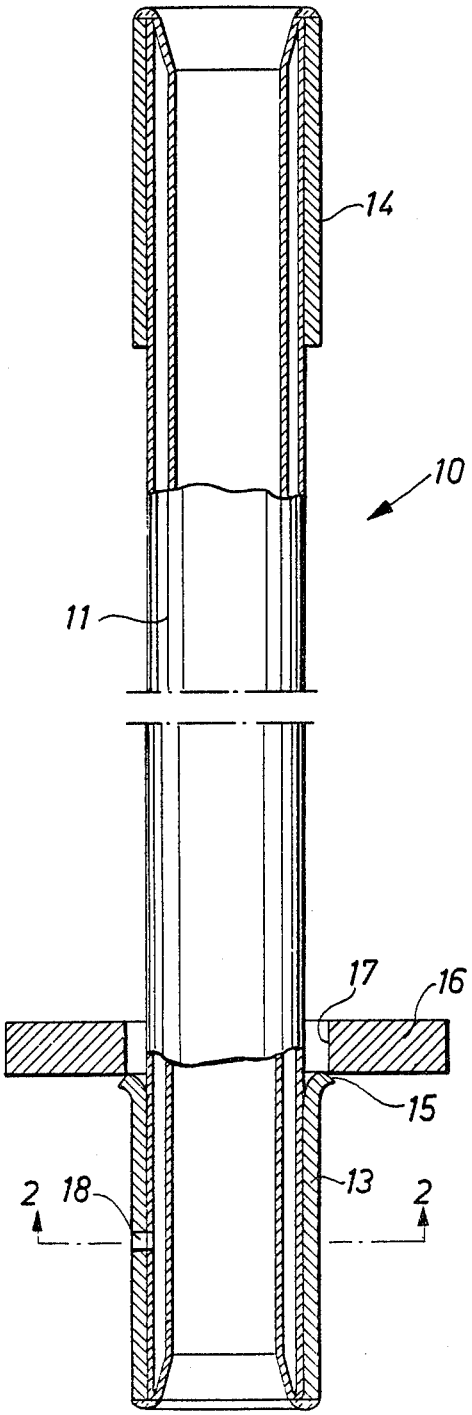
FIG. 1 shows a longitudinal view, partly in section, of a rock bolt suitable to be used in accordance with the invention, the rock bolt being shown before being used.
Figure 2:
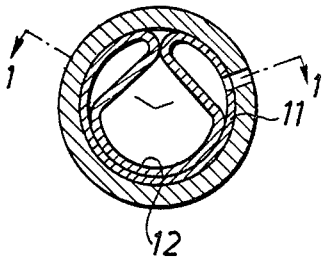
FIG. 2 is a section taken along line 2—2 in FIG. 1.
Figure 3:
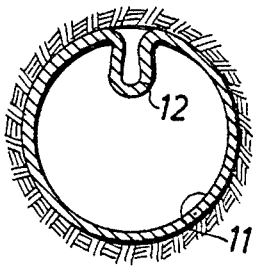
FIG. 3 is a sectional view of the rock bolt of FIG. 1 showing the rock bolt when expanded and anchored in a borehole in the rock.

The rock bolt 10 shown in FIGS. 1–3 comprises a tube 11 manufactured from a mild steel. The tube which originally had a circular periphery has been deformed and has a deep depression 12 so that its outer diameter is reduced. The depression 12 is so deep that it is in contact with the opposite wall. The original diameter can for example be 41 mm and the diameter after deformation can be 28 mm. Two sleeves 13, 14 have been pressed onto the ends of the tube 11 and the ends have been sealed through welding which also fixes the sleeves 13, 14 to the tube 11. The outer one 13 of the sleeves has a flange 15 which supports a washer 16. The hole 17 of the washer 16 permits the washer to be put onto the bolt 11 from the inner end thereof passing over the inner sleeve 14 and the tube 11 to the flange 15. A radial hole 18 is formed through the side wall of the outer sleeve 13 and the wall of the tube 11, through which the interior of the tube can be pressurized by a high pressure fluid, usually water, so that the tube 11 expands by being plastically deformed. In FIG. 3, the rock bolt is shown expanded in a borehole which is originally wider than the rock bolt so that the rock bolt was easily inserted in the borehole but which is smaller than the diameter of the original tube 11 before it had its diameter reduced as in FIG. 2. Therefore, the depression 12 could not completely expand during installation of the rock bolt in the borehole but it was reduced and left as an inwardly directed tongue 12. The tongue 12 was compressed by the water pressure and therefore, when the pressure is off, it acts as a spring and tends to widen so that it makes the rock bolt press against the side walls of the borehole. The bore hole may be more than 20% wider than the bolt prior to expansion if the bolt has the illustrated form and still a tongue 12 will be left after the expansion.

Figure 4:
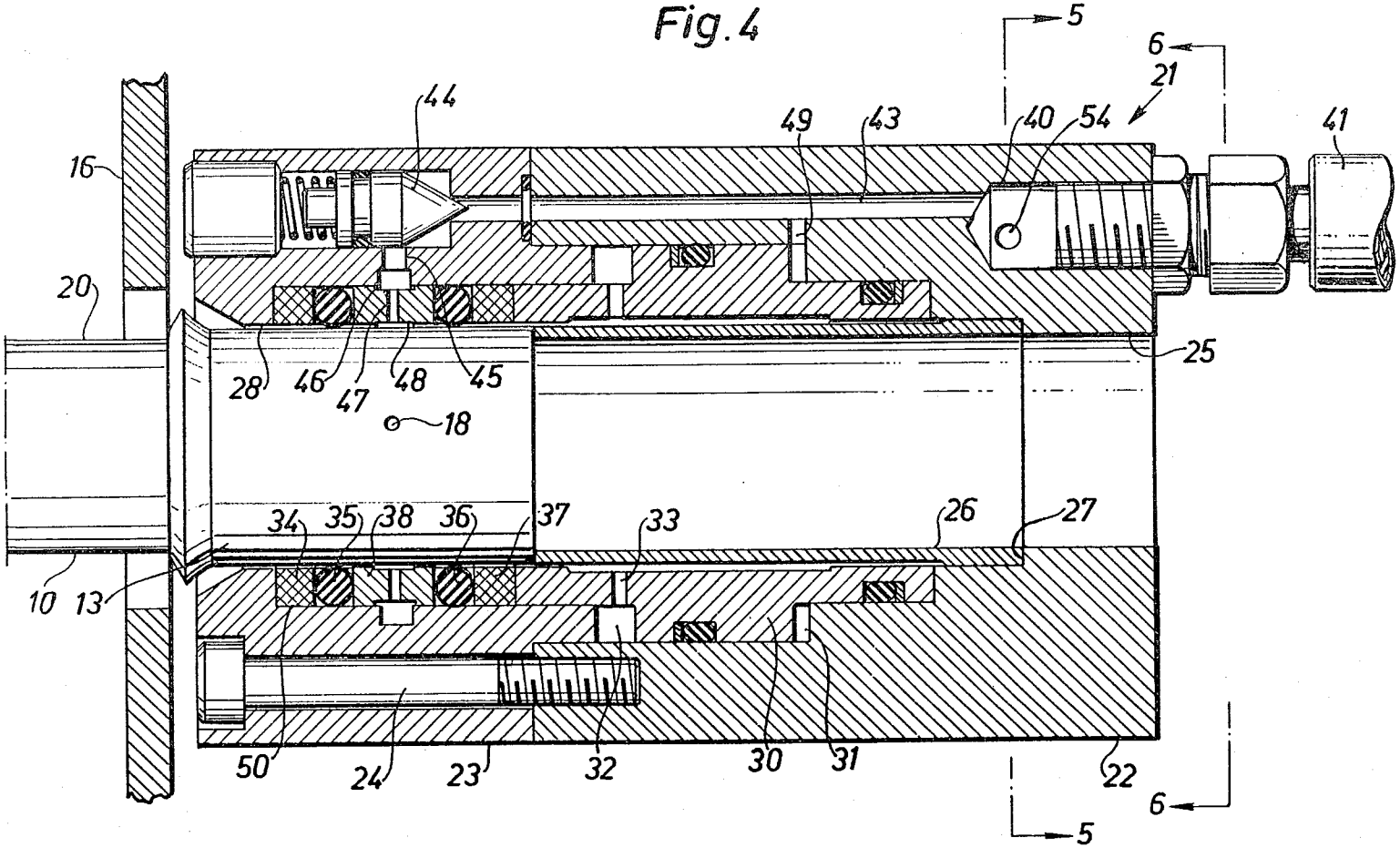
FIG. 4 is a longitudinal section of an installation device in accordance with the invention for installation of the rock bolt shown in FIGS. 1–3.
Figure 5:
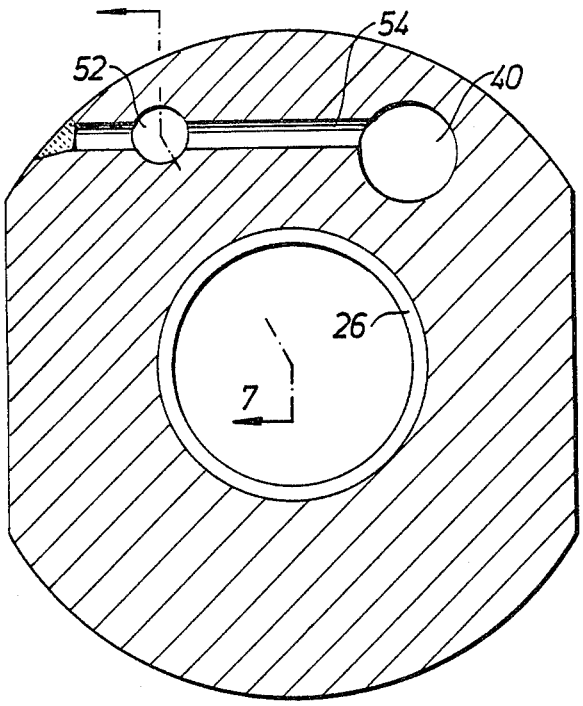
FIG. 5 is a transverse section taken on lines 5—5 in FIG. 4.

Referring to FIG. 4, the installation device or chuck 21 of the present invention comprises a housing that includes two pieces 22, 23 that are screwed together by screws 24. The housing 22, 23 has a through opening 25 and a sleeve 26 located in the opening 25 to take support on a shoulder 27 formed in the part 22 of the housing. The front part of the opening 25 forms a socket 28 for the sleeve 13 of the rock bolt 10 shown in FIGS. 1–3. The part 22 of the housing forms a stepped cylinder for an annular piston 30 so that two cylinder chambers 31, 32 are formed between the piston and the housing. The cylinder chamber 32 is constantly vented to the atmosphere via bores 33 and the clearance between the housing 22, 23 and the sleeve 26.

Figure 10:
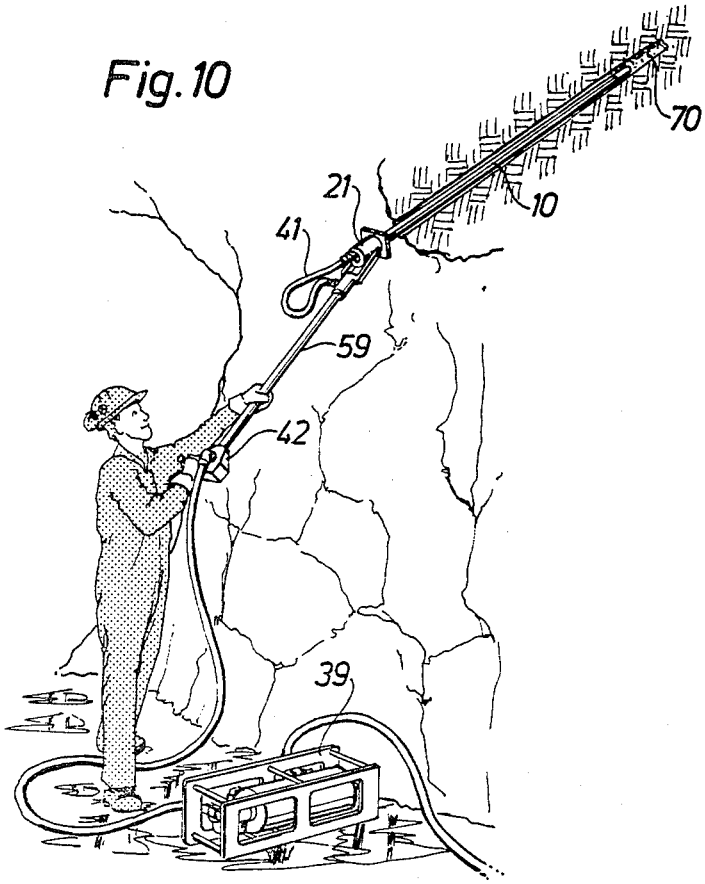
FIG. 10 shows the installation device of FIG. 4 or FIG. 7 mounted on an installation rod.

Four sealing rings 34–37 and a supply ring 38 are located in a row in an annular groove 50 in the socket 28 and the annular piston 30 is arranged to apply its axial load on the sealing rings 34–37 so as to deform the sealing rings to seal against the sleeve 13 of the rock bolt 10 on both sides of the supply ring 38. The supply ring 38 is axially slidable in the socket 28 so as to permit all of the seaing rings 34–37 to be deformed. The outer rings 34–37 are harder than the inner rings 35,36 and they are deformed only a little. They form backups for the sealing inner rings 35, 36 and prevent extrusion of the latter. The housing 22,33 has an inlet 40 to which a hose 41 for high pressure water is connected. The hose 41 is connected to a combined supply and drain valve 42 (FIG. 10) by which the hose 41 can be alternatively connected to a high pressure pump 39 (FIG. 10) or to drain. Referring back to FIG. 4, from the inlet 40, a supply passage 43 leads to a back pressure valve 44 and a passage 45 leads from the valve 44 to a wide annular recess 46 in the supply ring 38. Radial bores 47 lead from the wide annular recess 46 to another wide annular recess 48 in the inner surface of the supply ring 38. The supply passage 43 has a branch 49 that leads to the cylinder chamber 41.

Figure 7:
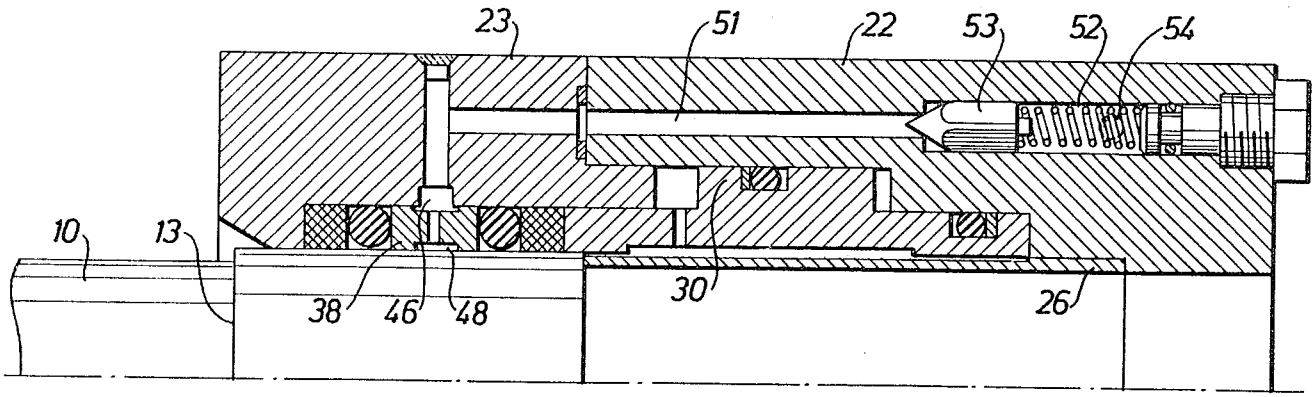
FIG. 7 is a fragmentary longitudinal section taken along line 7—7 in FIG. 5.

As seen in FIG. 7, a drain passage 51 leads from the annular recess 46 in the supply ring 38 to a check valve that has a square valving member 53 with a conical front end that is arranged to seat against the end of the passage 51. A passage 54 connects the circular cylinder 52 for the valving member 53 with the inlet 40.

Figure 6:
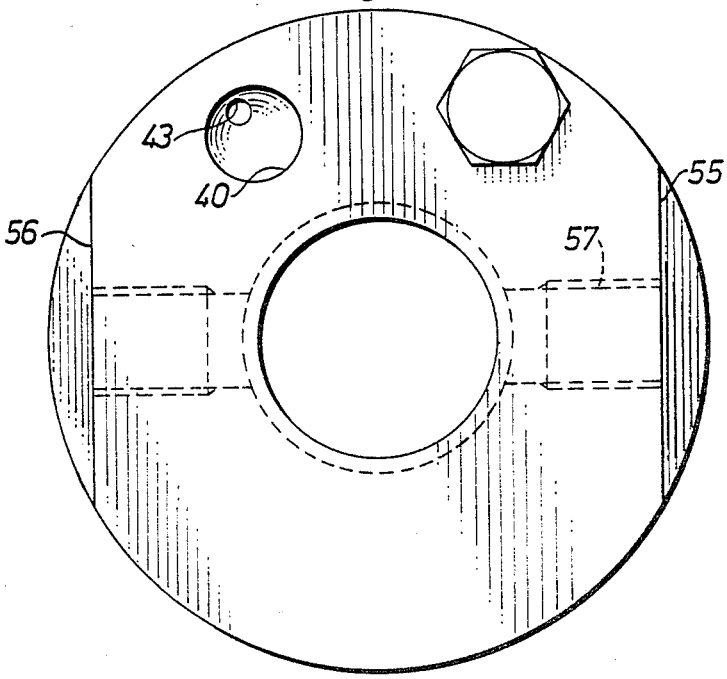
FIG. 6 is an end view seen as indicated by arrows 6 in FIG. 4.

Referring to FIG. 6, the chuck 21 has two flats 55, 56 with threaded holes 57, 58 so that it can be secured to any kind of carrier. It can for example be mounted on a rod 59 by means of which an operator can manually move the chuck 21 so as to insert a bolt in a pre-drilled hole 70 in the roof of a tunnel or the like. The supply valve 42 (see FIG. 10) would be mounted on the rod 59. The chuck 21 can also be mounted as the bolt setter of a rock bolting apparatus of any known kind, for example a rock bolting apparatus as described in U.S. Pat. No. 4,158,520 or in U.S. Pat. No. 3,246,705.

When a rock bolt 10 is to be anchored in a pre-drilled hole in order to reinforce the rock, the end of the bolt is inserted in the chuck 21 as shown in FIG. 4, and the chuck is moved so as to insert the bolt in the bore hole. When the bolt is home, high pressure water is supplied through the hose 41 to the inlet 40. The water pressure moves the piston 30 so that the sealing rings 35, 36 seal against the sleeve 12 of the rock bolt. The annular recesses 46 and 48 are so wide that they always keep the passage between the passage 45 and the hole 18 in the rock bolt open. Then, when the sealing rings 35, 36 seal, the pressure increases further and the back pressure valve 44 opens at a predetermined pressure to supply high pressure water to the interior of the tube formed bolt 10 through the hole 18 in the bolt.

Once the valve 44 has opened it remains open even if there is a pressure decrease since the pressure influenced area is substantially increased when the valve opens. The valve 53 in the drain passage 51 remains closed since it is spring biassed closed by a weak spring. When the pressure of the supplied water has reached a predetermined level, for example 250 bar, the supply valve 42 (FIG. 10) is manually or automatically shifted to instead drain the supply hose 41 and the inlet 40. Since the passage 54 is also drained, the check valve 53 opens to form a drain passage from the passage 51 to the passage 54, and the valve 44 closes. The piston 30 relieves its axial load on the sealing rings 34–37 as the water pressure decreases and the chuck 21 can be removed from the bolt 10 which is now anchored in the borehole.

Figure 8:
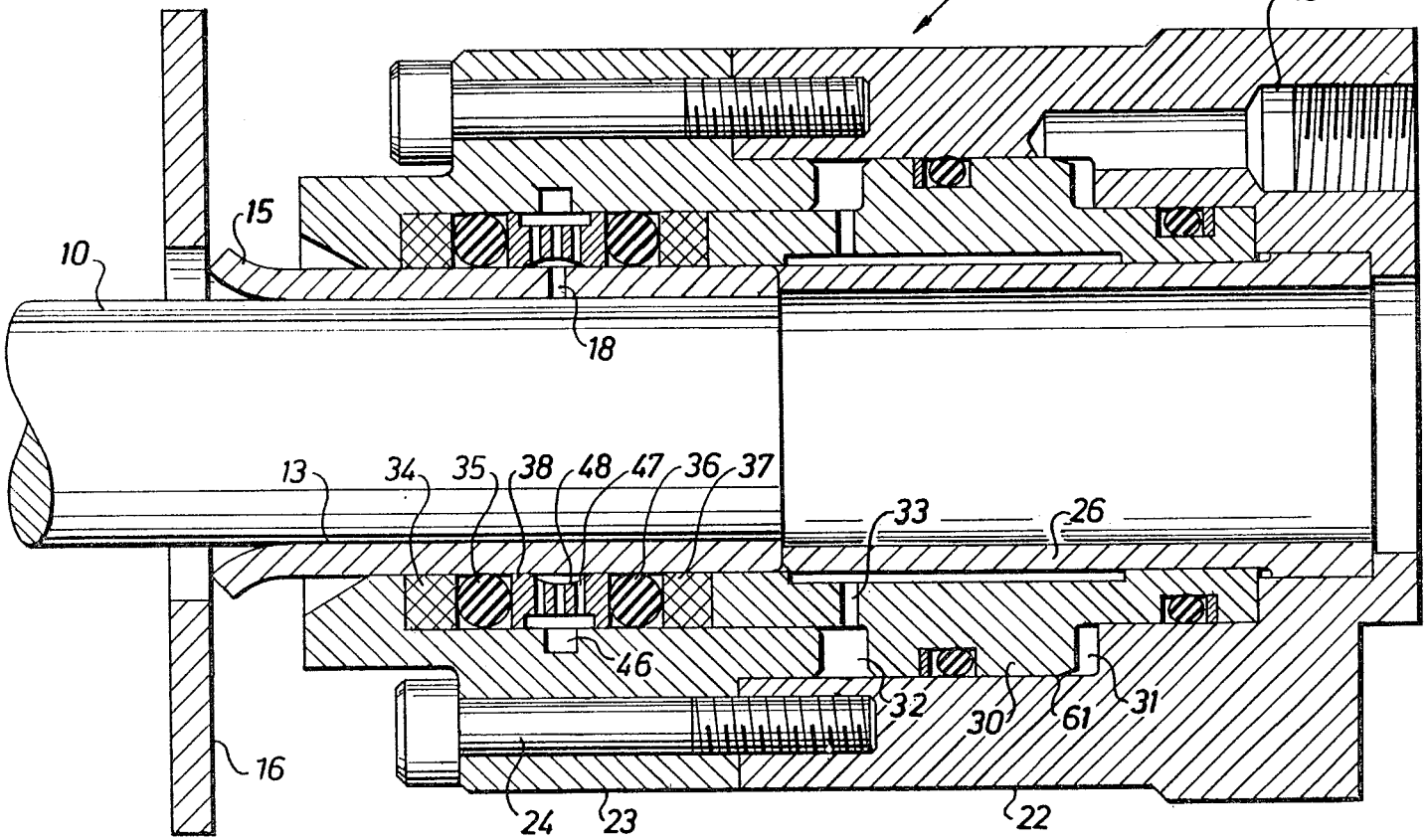
FIG. 8 is a longitudinal section of a modified installation device according to the invention.
Figure 9:
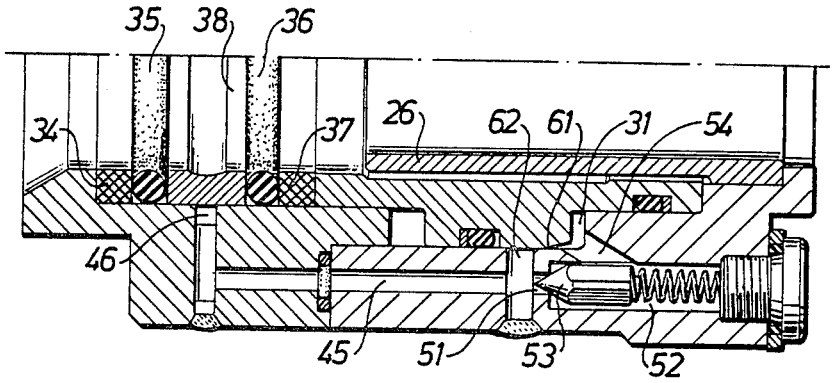
FIG. 9 is another fragmentary longitudinal section through the installation device shown in FIG. 8

In the installation device or chuck shown in FIGS. 8 and 9, details which correspond to details of the installation device shown in FIGS. 4–7 have been given the same reference numerals. The edge 61 of the annular piston 30 forms a spool valve that controls a port 62 of passage 45 that leads to the supply ring 38. This valve 61, 45 replaces the pressure operated valve 44 in FIG. 1, and it does not supply high pressure water to the supply ring 38 until the sealing rings 35, 36 have been compressed. When the hose 41 is drained, the pressure water from the bolt is drained through the check valve 52 to the hose 41.

Various modifications can be made. For example, the rock bolt can first be placed in the borehole and the holder 21 can thereafter be attached to the rock bolt for expanding the rock bolt in the borehole.

I claim:

1. Method of rock bolting by using a fluid expansible tube-formed rock bolt (10) having an internal elongated pressure fluid receiving chamber that is closed at both of its ends but has a fluid inlet (18) at one end thereof which is in fluid communication with the interior of said chamber, said rock bolt (10) being provided with a cylindrical sleeve (13) on said one end and a supply hole through said sleeve to the interior of said chamber of said rock bolt to provide said fluid inlet (18), said chamber being pressurized to expand the tube formed rock bolt in a borehole, characterized by the steps of:

inserting said one end of said rock bolt (10) in a bolt socket (28) of a holder (21) so that a fluid conduit (40, 45, 47) of said holder is in fluid communication with said fluid inlet (18) of said rock bolt;

moving said holder (21) to insert said rock bolt (10) into a borehole;

supplying high pressure liquid through said fluid conduit (40, 45, 47) of said holder (21) and through said fluid inlet (18) to said chamber of said rock bolt to plastically deform said rock bolt (10) so as to be expanded and anchored in the borehole;

sealing off said socket (28) of said holder (21) against said sleeve (13) axially on both sides of said fluid inlet (18) at least during supplying said high pressure liquid to said fluid inlet (18) through said conduit (40, 45);

relieving said conduit (40, 45, 47) of fluid pressure and thereby relieving said chamber of said rock bolt (10) of fluid pressure; and removing said holder (21) from said rock bolt, said rock bolt remaining anchored in the borehole.

2. The method of claim 1, comprising sealing off said socket (28) of said holder against said sleeve (13) axially on both sides of said fluid inlet (18) before supplying said high pressure fluid to said supply hole (18) through said conduit (40, 45).

3. The method of claim 1, comprising supplying from a common source said high pressure liquid to a means for sealing off said socket (28); and providing a valve means for preventing supplying of said high pressure liquid to said supply hole (18) through said conduit (40, 45) until after completion of sealing off of said socket (28) against said sleeve (13).

4. Method of rock bolting by using a fluid expansible tube-formed rock bolt (10) having an internal elongated pressure fluid receiving chamber that is closed at both of its ends but has a fluid inlet (18) at one end thereof which is in fluid communication with the interior of said chamber, said rock bolt (10) being provided with a cylindrical sleeve (13) on said one end and a supply hole through said sleeve to the interior chamber of said rock bolt to provide said fluid inlet (18), said chamber being pressurized to expand the tube formed rock bolt in a borehole to anchor the rock bolt in the borehole, characterized by the steps of:

inserting said one end of said rock bolt (10) in a bolt socket (28) of a holder (21) so that a fluid conduit (40, 45, 47) of said holder is in fluid communication with said fluid inlet (18) of said rock bolt:

supplying high pressure liquid through said fluid conduit (40, 45, 47) of said holder (21) and through said fluid inlet (18) to said chamber of said rock bolt to plastically deform said rock bolt (10) so as to be expanded and anchored in the borehole;

sealing off said socket (28) of said holder (21) against said sleeve (13) axially on both sides of said fluid inlet (18) at least during supplying said high pressure liquid to said fluid inlet (18) through said conduit (40, 45);

relieving said conduit (40, 45, 47) of said fluid pressure and thereby relieving said chamber of said rock bolt (10) of fluid pressure; and removing said holder (21) from said rock bolt, said rock bolt remaining anchored in the borehole.

5. The method of claim 4, comprising sealing off said socket (28) of said holder against said sleeve (13) axially on both sides of said fluid inlet (18) before supplying said high pressure fluid to said fluid inlet (18) through said conduit (40, 45).

6. The method of claim 4, comprising supplying from a common source said high pressure liquid to a means for sealing off said socket (28); and providing a valve means for preventing supplying of said high pressure liquid to said fluid inlet (18) through said conduit (40, 45) until after completion of sealing off of said socket (28) against said sleeve (13).

7. A combination of an expansible rock bolt (10) and an installation device (21, 59, 42) for same wherein said rock bolt comprises an elongated tube (11) that has an axial depression (12) and an internal pressure fluid receiving chamber which is closed at both of its ends, but has a fluid inlet, characterized in that:

said bolt (10) comprises a sleeve (13) on one end of the tube which is the outer end of said tube, said sleeve (13) having a hole (18) through said sleeve (13) to said internal chamber of said tube (11), said hole forming said fluid inlet; and said installation device comprises: a holder (21) having a socket (28) for receiving said sleeve (13); two axially spaced sealing means (34, 35 and 36, 37 resp.) in said socket (28) for sealing against said sleeve (13) on opposite sides of said hole (18) of said sleeve; and passage means (40, 45, 47) in said holder and terminating between said two axially spaced sealing means;

said hole (18) in said sleeve (13) being arranged to be located axially between said two axially spaced sealing means and in fluid communication with said passage means when said sleeve (13) is home in said socket (28); and said installation device further comprises coupling means (41, 42) for coupling said passage means (40, 45, 47) to a source of pressure fluid (39) for expanding the tube (11) by pressure fluid being fed from said pressure fluid source, through said passage means, and through said hole (18) in said sleeve and into said chamber of said tube.

8. The combination of claim 7 wherein said coupling means of said installation device (21, 59, 42) comprises:

an installation rod (59) on which said holder (21) is mounted; and a supply valve (42) mounted on said rod (59), said supply valve (42) being coupled to said passage means (40, 45, 47) and connectable to said source of pressure fluid (39).

9. The combination of claim 7 or 8 wherein said holder (21) comprises:

an annular groove (50) in said socket (28);

a supply ring (38) axially slidable in said groove (50), and forming a part of said passage means (40, 45, 47), said sealing rings (34, 35 and 36, 37 resp.) being located axially on respective opposite sides of said supply ring (35) in said groove (50); and an axially movable piston (30) for axially compressing said sealing rings (34, 35 and 36, 37 resp.) to seal against said sleeve (13) of said rock bolt.

10. The combination of claim 9, wherein said piston (30) is slidably mounted in said groove (50).

11. The combination of claim 9, wherein said piston (30) is coupled to said source of pressure fluid (39) so as to be actuated by said pressure fluid to axially compress said sealing rings.

12. A combination of claim 7 wherein the tube (11) has a deep depression (12) that extends axially along the tube.

13. The combination of claim 12, wherein said depression (12) is so deep that the tube can increase its diameter at least 20% before the depression has expanded completely.

14. An installation device for use with an expansible rock bolt (10), said rock bolt comprising an elongated tube (11) that has an axial depression (12) and an internal pressure fluid receiving chamber which is closed at both of its ends; a sleeve (13) on one end of the tube which is the outer end of said tube, said sleeve (13) having a hole (18) through said sleeve (13) and extending to said internal chamber of said tube (11);

said installation device comprising:

a holder (21) having a socket (28) for receiving said sleeve (13) of said rock bolt;

two axially spaced sealing means (34, 35, and 36, 37, resp.) in said socket (28) for sealing against said sleeve (13) on opposite sides of said hole (18) of said sleeve;

passage means (40, 45, 47) in said holder and terminating between said two axially spaced sealing means so that said hole (18) in said sleeve is in fluid communication with said passage means when said sleeve (13) is home in said socket (28); and coupling means (41, 42) for coupling said passage means (40, 45, 47) to a source of pressure fluid (39)

for expanding the tube (11) by pressure fluid being fed from said pressure fluid source, through said passage means and through said hole (18) in said sleeve and into said chamber of said tube.

15. The installation device of claim 14, wherein said coupling means of said installation device (21, 59, 42) comprises:

an installation rod (59) on which said holder (21) is mounted; and a supply valve (42) mounted on said rod (59), said supply valve (42) being coupled to said passage means (40, 45, 47) and connectable to said source of pressure fluid (39).

16. The installation device of claim 14 or 15, wherein said holder (21) comprises:

an annular groove (50) in said socket (28);

a supply ring (38) axially slidable in said groove (50), and forming a part of said passage means (40, 45, 47), said sealing rings (34, 35 and 36, 37 resp.) being located axially on respective opposite sides of said supply ring (35) in said groove (50); and an axially movable piston (30) for axially compressing said sealing rings (34, 35 and 36, 37 resp.) to seal against said sleeve (13) of said rock bolt.

17. The installation device of claim 16, wherein said piston (30) is slidably mounted in said groove (50).

18. The installation device of claim 16, wherein said piston (30) is coupled to said source of pressure fluid (39) so as to be actuated by said pressure fluid to axially compress said sealing rings.

19. The installation device of claim 14 wherein the tube (11) has a deep depression (12) that extends axially along the tube.

20. The installation device of claim 19 wherein the depression (12) is so deep that the tube can increase its diameter at least 20% before the depression has expanded completely.

* * * * *

UNITED STATES PATENT AND TRADEMARK OFFICE

CERTIFICATE OF CORRECTION

PATENT NO. : 4,423,986

DATED : January 3, 1984

INVENTOR(S) : Bo T. SKOGBERG

It is certified that error appears in the above-identified patent and that said Letters Patent is hereby corrected as shown below:

COLUMN 4 (claim 2), line 67, change "supply hole" to --fluid inlet--;

COLUMN 5 (claim 3), line 5, change "supply hole" to --fluid inlet--.

Signed and Sealed this

*First* Day of *May 1984*

[SEAL]

*Attest:*

GERALD J. MOSSINGHOFF

*Attesting Officer*

*Commissioner of Patents and Trademarks*